US006869072B2

(12) United States Patent
Andersson

(10) Patent No.: US 6,869,072 B2
(45) Date of Patent: Mar. 22, 2005

(54) DEVICE AND A METHOD FOR FEEDING PACKAGING BLANKS

(75) Inventor: Roland Andersson, Malmö (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 174 days.

(21) Appl. No.: 10/297,328

(22) PCT Filed: Sep. 24, 2001

(86) PCT No.: PCT/SE01/02040

§ 371 (c)(1),
(2), (4) Date: Dec. 5, 2002

(87) PCT Pub. No.: WO02/28753

PCT Pub. Date: Apr. 11, 2002

(65) Prior Publication Data

US 2003/0173732 A1 Sep. 18, 2003

(30) Foreign Application Priority Data

Oct. 4, 2000 (SE) ..... 0003563-4

(51) Int. Cl.[7] ..... B65H 1/02
(52) U.S. Cl. ..... 271/149
(58) Field of Search ..... 271/149, 145, 271/150, 248, 251, 254

(56) References Cited

U.S. PATENT DOCUMENTS

| | | | | |
|---|---|---|---|---|
| 3,783,584 A | | 1/1974 | Rauser | |
| 3,785,113 A | | 1/1974 | Martensson et al. | |
| 4,295,645 A | * | 10/1981 | Nahar et al. | 271/34 |
| 4,448,008 A | | 5/1984 | Pankratz et al. | |
| 4,493,687 A | | 1/1985 | Bernle | |
| 4,510,732 A | | 4/1985 | Löthman | |
| 4,828,244 A | | 5/1989 | Sardella | |
| 5,190,278 A | | 3/1993 | Wallin et al. | |
| 6,241,242 B1 | * | 6/2001 | Munro | 271/252 |
| 6,267,372 B1 | * | 7/2001 | Mylaeus et al. | 271/250 |
| 6,425,579 B1 | * | 7/2002 | Andreyka et al. | 271/147 |

FOREIGN PATENT DOCUMENTS

| | | |
|---|---|---|
| EP | 0 287 983 A1 | 10/1988 |
| EP | 0 339 178 A1 | 11/1989 |
| GB | 1010428 A | 11/1965 |
| GB | 2 195 321 A | 4/1988 |
| SE | 462485 B | 7/1990 |

* cited by examiner

*Primary Examiner*—Donald P Walsh
*Assistant Examiner*—Kenneth W. Bower
(74) *Attorney, Agent, or Firm*—Burns, Doane, Swecker & Mathis, L.L.P.

(57) ABSTRACT

A device for feeding packaging blanks (3) to a packaging machine has a magazine with two shafts (7) mounted at the bottom for supporting the blanks (3). The shafts (7) are brought to rotate at constant speed in opposite directions to each other, hence eliminating the static friction from the bottom of the magazine. An angle is formed between the shafts (7), so that a small, forwardly directed force component contributes to the movement of the blanks (3). The dynamic friction is used to move blanks (3) towards a gate (2) at the end of the magazine, and only a small, constant feeding force (A) from a pusher is necessary for the movement.

11 Claims, 2 Drawing Sheets

DEVICE AND A METHOD FOR FEEDING PACKAGING BLANKS

TECHNICAL FIELD

The present invention relates to a device for feeding packaging blanks one by one to a packaging machine for filling.

The invention also relates to a method for moving the packaging blanks in a magazine of the device before feeding them to the packaging machine.

PRIOR ART

Devices for automatically feeding packaging blanks, for example for cartons, to a packaging machine for filling are previously known. Such a device has usually a magazine with a flat bottom, made for example of aluminium, the blanks being supported on the bottom of the magazine. However, a serious problem with these currently used devices is the uneven feeding of blanks due to the static friction at moving the blanks along the bottom of the magazine. The effect of slip-stick, arising when the coefficient of friction generates a force that is higher than the feeding force, will result in missing blanks or more than one blank at feeding instead of desirably one blank.

Another problem is that a higher force is needed for moving the blanks in a recently loaded magazine than in an almost empty one.

Yet another problem is the spring-back effect arising when the folded blanks tend to spring back to their original position, which occurs more frequently when static friction is present and which contributes to an uncontrolled feeding force.

Attempts have been made to overcome those problems by implementing different types of force reductions. Vibrators as well as moving guides have also been tested to decrease the effect of static friction or to eliminate it but have turned out to be unsuccessful.

SUMMARY OF THE INVENTION

An object of the present invention is to remedy the drawbacks above and to provide a device and a method for feeding packaging blanks to a packaging machine in a well-defined and controlled way.

A more specific object of the present invention is to provide a device and a method for feeding packaging blanks to a packaging machine where the feeding force on the consecutive packaging blanks in a magazine of the device is small and constant due to use of dynamic friction and elimination of the static friction at the bottom of the magazine.

In order to achieve said objects the invention provides a device having a magazine with one or more shafts at the bottom of the magazine. The one or more shafts extends in a direction along which the blanks are to be fed. Bringing the one or more shafts to rotate at constant speed by means of a motor eliminates the static friction when pushing the blanks along the bottom of the magazine.

Preferably, the one or more shaft has a length corresponding to that of the bottom of the magazine, and is positioned in the same plane as the bottom. If two shafts are provided they are angled to each other and are brought to rotate at constant speed in opposite directions to each other. Only dynamic friction is then present, which makes it possible to get a constant feeding force on the packaging blanks. Other objects, features and advantages of the present invention will appear from the following detailed description, from the attached drawings as well as from the dependent claims.

BRIEF DESCRIPTION OF THE DRAWINGS

The invention will be described in further detail below with reference to the accompanying drawings, in which.

DETAILED DESCRIPTION OF A PREFERRED EMBODIMENT

Figure 1:
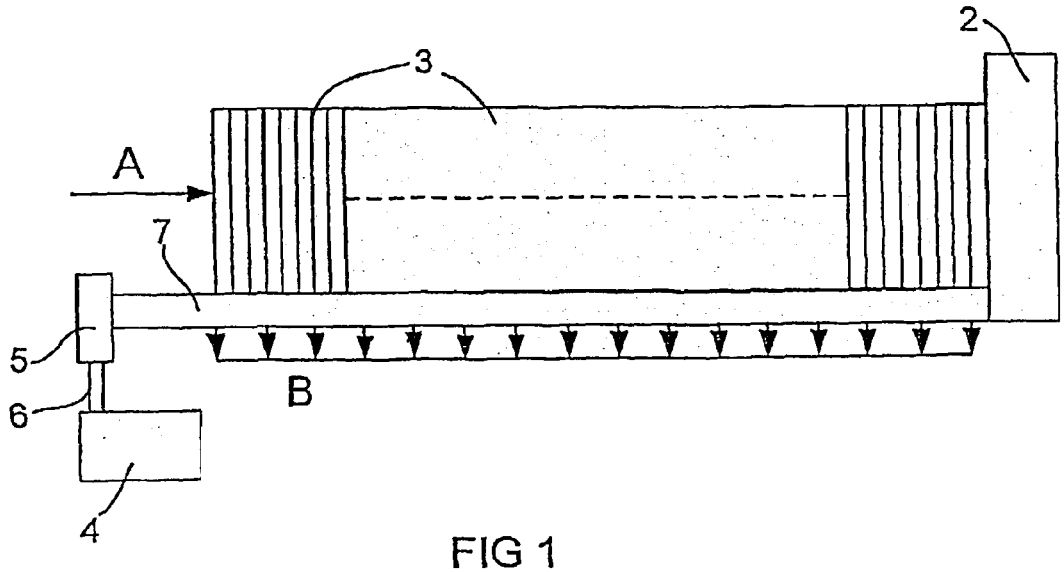
FIG. 1 is a schematic side view of a device for feeding packaging blanks to a packaging machine according to the invention, blanks being positioned in a magazine of the device, wherein the force distribution needed for moving the packaging blanks in the device is illustrated.

A device for feeding packaging blanks 3 to a packaging machine is schematically shown in FIG. 1. The device has a magazine, provided with one or more shafts 7 at the bottom and a gate 2. The openable gate 2 acts as a stop at the outlet end of the magazine. A motor 4 is connected to drive means 5 by a drive shaft 6. Packaging blanks 3 are loaded in the magazine, where the blank 3 to be fed to the packaging machine (not shown) abuts the gate 2.

Figure 2:
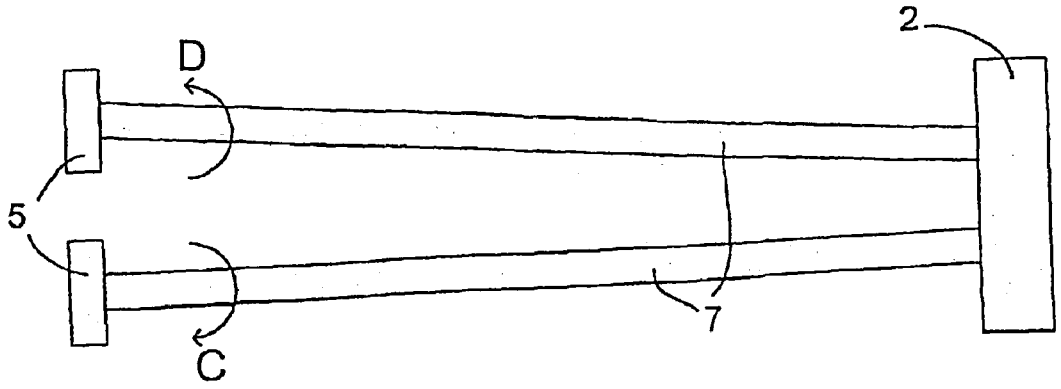
FIG. 2 is a schematic top view showing the bottom of a device according to the invention.

FIG. 2 shows a schematical top view of the device in FIG. 1, wherein at the bottom of the magazine two shafts 7 are provided, which are connected to the drive means 5 and hence are in communication with the motor 4. The length of the shafts 7 corresponds to the length of the magazine. The shafts 7 are angled to each other, the distance between the shafts 7 being smaller at the gate 2 at the outlet end of the magazine, and are mounted in the same plane as the bottom of the magazine.

The device may further comprise a robot (not shown) for reloading the magazine with packaging blanks 3 when the magazine is almost empty; a pusher (not shown) comprising for example pneumatic means for moving the blanks 3 forward in the magazine to the gate 2, illustrated by the arrow A; and dogs (not shown) at the gate 2 for feeding the blanks 3 one by one to the packaging machine.

Figure 3:
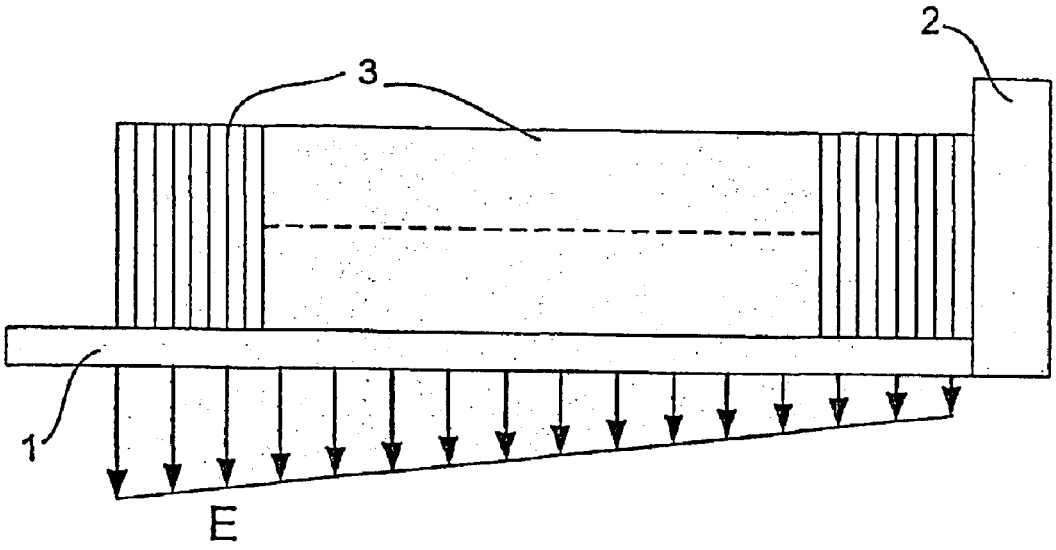
FIG. 3 is a schematic side view of a traditional device for feeding packaging blanks to a packaging machine, wherein the force distribution needed for moving the packaging blanks in the device is illustrated.

In currently used devices for feeding packaging blanks 3 to a packaging machine the magazines have a flat bottom 1 made of e.g. metal, preferably aluminium, with a certain coefficient of friction. The static friction will hinder the blanks 3 from moving smoothly and evenly in the magazine. Another consequence of the static friction to consider is that the required force to move the blanks 3 has to be rather high when the magazine recently is reloaded, while this force will decrease as the magazine contains fewer and fewer blanks 3, as illustrated by the arrows E in FIG. 3. The effect of slip-stick will arise when the coefficient of friction generates a force that is higher than the feeding force. The result of this effect is that the blanks 3 stick to the bottom 1 of the magazine during the forward movement thus leading to an uneven movement, which may jeopardize a secure feeding of blanks 3 one by one to the packaging machine.

Another fact to take into account is the effect of spring-back, which increase when static friction is present. This effect arises when the loaded and folded packaging blanks 3 in the magazine tend to spring back to their original position. The feeding force becomes uncontrolled when the blanks 3 act in this way. The above-disclosed problems are solved according to the invention by using only the dynamic friction without static friction. The packaging blanks 3 in the magazine are supported on the shafts 7, which are brought to rotate at constant speed, in opposite directions to each other, as illustrated by the arrows C and D in FIG. 2, by means of the motor 4. Due to the rotation and since the shafts 7 are not parallel a small, forwardly directed force component will contribute at the movement of the blanks 3 in a floating way towards the gate 2, and only a small, constant feeding force, as illustrated by the arrows B in FIG. 1, is required from the pusher for moving the blanks 3 in the magazine to the gate 2. The moment of feeding the blanks one by one by the dogs to the packaging machine will be safely performed at constant speed, since the blanks have a well-defined position.

At reloading the magazine with blanks 3 when empty, the defined force from the effect of spring-back under control may be used. At this stage the pusher disappears for a short moment so that the robot can fill up the magazine with blanks 3. The force from the spring-back effect and the small force component due to the angled shafts at rotation cooperate to continuously move the blanks 3 towards the gate 2 without interruption. There are fewer limitations regarding the magazine length according to the invention, and it is possible to load more packaging blanks 3 in the magazine. It is also possible to have a wider range of feeding speeds. Another advantage is that small, undesirable marks on the blanks 3 do not appear when the shafts 7 are angled to each other and are rotating.

The present invention has been described with reference to an illustrative embodiment for exemplifying but not limiting purposes. As will be readily realized by a man skilled in the art, other embodiments than the one disclosed herein are possible within the scope of the claims, as for example having several rotating shafts 7 for supporting blanks 3 when loaded in a magazine.

What is claimed is:

1. A device having a magazine for feeding packaging blanks to a packaging machine for filling, comprising at least one rotating shaft, which extends substantially in a direction along which said blanks are to be fed, and which shaft is arranged at the bottom of the magazine for supporting the blanks in the magazine.

2. A device according to claim 1, wherein the length of the at least one shaft corresponds to that of the bottom.

3. A device according to claim 2, further comprising a pusher for moving the blanks in the magazine, means for reloading the magazine with blanks, and means for transferring the blanks one by one to the packaging machine.

4. A device according to claim 2, which comprises two shafts.

5. A device according to claim 4, further comprising a pusher for moving the blanks in the magazine, means for reloading the magazine with blanks, and means for transferring the blanks one by one to the packaging machine.

6. A device according to claim 4, wherein the shafts are rotatable around their axes in a plane parallel to the bottom of the magazine and in opposite directions to each other.

7. A device according to claim 6, further comprising a pusher for moving the blanks in the magazine, means for reloading the magazine with blanks, and means for transferring the blanks one by one to the packaging machine.

8. A device according to claim 6, wherein the shafts form an angle with each other in a plane parallel to the bottom of the magazine, the distance between the shafts being smaller at the outlet end of the magazine where the blanks are transferred to the packaging machine.

9. A device according to claim 8, further comprising a pusher for moving the blanks in the magazine, means for reloading the magazine with blanks, and means for transferring the blanks one by one to the packaging machine.

10. A device according to claim 1, further comprising a pusher for moving the blanks in the magazine, means for reloading the magazine with blanks and means for transferring the blanks one by one to the packaging machine.

11. A method for moving packaging blanks in a magazine to a packaging machine for filling, comprising providing a movable support for the blanks at a bottom of the magazine, wherein said movable support comprises at least one shaft, which extends substantially in a direction along which said blanks are to be fed, and which shaft is arranged at the bottom of the magazine for supporting the blanks in the magazine, whereby said at least one shaft is rotating.

* * * * *